US006018142A

United States Patent [19]

Lee et al.

[11] Patent Number: 6,018,142

[45] Date of Patent: Jan. 25, 2000

[54] GLOW PLUG CERAMIC HEATER

[75] Inventors: Jae Do Lee; Young Min Choi; Oh Sang Lee, all of Daejonkwangyok-si; Sang Hoon Lee, Seoul, all of Rep. of Korea

[73] Assignee: Korea Research Institiute of Chemical Technology, Kaejonkwangyok-si, Rep. of Korea

[21] Appl. No.: 09/033,612

[22] Filed: Mar. 3, 1998

[30] Foreign Application Priority Data

Mar. 3, 1997 [KR] Rep. of Korea ..... 97/6961

[51] Int. Cl.[7] ..... F23Q 7/22

[52] U.S. Cl. ..... 219/270

[58] Field of Search ..... 219/270, 542, 219/543, 544, 548, 553, 409

[56] References Cited

U.S. PATENT DOCUMENTS

| | | | |
|---|---|---|---|
| 4,502,430 | 3/1985 | Yokoi et al. | 123/145 |
| 4,525,622 | 6/1985 | Kawamura et al. | 219/270 |
| 4,650,963 | 3/1987 | Yokoi | 219/270 |
| 4,719,331 | 1/1988 | Ito et al. | 219/270 |
| 4,912,305 | 3/1990 | Tatemasu et al. | 219/544 |
| 5,264,681 | 11/1993 | Nozaki et al. | 219/544 |

FOREIGN PATENT DOCUMENTS

| | | |
|---|---|---|
| 2-183718 | 7/1990 | Japan . |
| 4-174991 | 6/1992 | Japan . |

*Primary Examiner*—Teresa Walberg
*Assistant Examiner*—Vinod D Patel
*Attorney, Agent, or Firm*—Foley & Lardner

[57] ABSTRACT

A silicon-based ceramic heater suitable for use in a glow plug of a diesel engine, the heater comprising a refractory metal heating element, preferably a wire which consists essentially of tungsten (W), molybdenum (Mo), or an alloy of tungsten and molybdenum; a titanium nitride (TiN) coating on the heating element, which coating serves as a barrier to the diffusion of silicon and defines a coated heating element; and a sintered body, preferably consisting essentially of silicon nitride ($Si_3N_4$), silicon carbide (SiC), or a composite of silicon nitride and silicon carbide, within which the coated heating element is embedded.

12 Claims, 2 Drawing Sheets

GLOW PLUG CERAMIC HEATER

BACKGROUND OF THE INVENTION

1. Field of the Invention

The present invention is related to a ceramic heater and, more particularly, to a ceramic heater suitable for use in a diesel engine glow plug.

2. Discussion of the Related Art

Restrictions on diesel engine emissions, which can be expected to become ever more stringent, are more easily satisfied by increasing the temperature of the engine's glow plugs, which significantly enhances the engine'cold start characteristics and reduces the generation of exhaust gases such as white smoke. Ceramic heaters, formed by embedding a heating element consisting of a refractory metal (typically a tungsten wire) within a body consisting of a sintered, silicon-based ceramic (typically silicon nitride), are generally used in glow plugs. The durable ceramic heaters thus formed are resistant to both corrosion and thermal shock in high-temperature ambients (the maximum temperature at the surface of a glow plug ceramic heater in a typical diesel engine is roughly 900° C.).

Should such a ceramic heater be sintered at temperatures of 1600~1800° C. during formation or exposed to surface temperatures in excess of 1300° C. during operation (as would be the case in a gas injection diesel engine), the operational characteristics of the ceramic heater would suffer due to chemical reaction between the silicon nitride body and the tungsten of the heating wire. Tungsten consumed by the formation of tungsten silicide ($WSi_2$) at the interface of the wire and the body would locally reduce the cross sectional area of the wire. Local decreases in the area of the heating element would in turn cause local increases in resistance and the resultant local overheating would cause premature rupture of the tungsten heating element. Conventional ceramic heaters are thus not used at temperatures much in excess of 900° C.

SUMMARY OF THE INVENTION

Accordingly, the present invention is directed to a ceramic heater suitable for use in a diesel engine glow plug that substantially obviates one or more of the limitations and disadvantages of ceramic glow plug heaters disclosed in the prior art. An object of the present invention is thus to provide a ceramic heater which has an expected lifetime significantly greater than the lifetimes of ceramic heaters disclosed in the prior art, especially where the glow plug is exposed to temperatures in excess of 1300° C.

Additional features and advantages of the invention are set forth in the description which follows and either will be apparent from the present description or may be learned by practice of the invention. The objectives and advantages of the invention will be realized and attained by the structure disclosed in the written description, the claims, and the drawings.

The ceramic heater of the present invention includes: a refractory metal resistive heating element, preferably a wire consisting essentially of tungsten (W), molybdenum (Mo), or an alloy of tungsten and molybdenum; a coating on the heating element which serves as a barrier to the diffusion of silicon, preferably a uniform layer of titanium nitride (TiN); and a sintered body of silicon nitride ($Si_3N_4$), silicon carbide (SiC), or a composite of silicon nitride and silicon carbide within which the coated heating element is embedded.

It is to be understood that both the foregoing general description and the following detailed description are exemplary and explanatory and are intended to provide further explanation of the invention as claimed.

DETAILED DESCRIPTION OF THE PREFERRED EMBODIMENTS

As briefly described above, the ceramic heater of the present invention comprises:

- a refractory metal heating element, preferably a wire which consists essentially of tungsten (W), molybdenum (Mo), or an alloy of tungsten and molybdenum;
- a titanium nitride (TiN) coating on the heating element, which serves as a barrier to the diffusion of silicon and defines a coated heating element; and
- a sintered body, preferably consisting essentially of silicon nitride ($Si_3N_4$), silicon carbide (SiC), or a composite of silicon nitride and silicon carbide, within which the coated heating element is embedded.

The titanium nitride (TiN) layer of the present invention serves as a barrier to the diffusion of silicon (Si) from the body of the heater to the tungsten (W) heating element and thus inhibits the formation of $WSi_2$ at the interface between the body and the heating element due to the chemical reaction of silicon. The titanium nitride diffusion barrier significantly increases both the useful temperature range and the expected lifetime of the ceramic heater and, indeed, becomes more important as the temperature increases, since both the diffusivity of silicon (through the ceramic body of the heater) and the reaction rate of silicon and tungsten (at the interface between the body and the heating element) increase with increasing temperature. The titanium nitride layer of the present invention is thus an effective barrier to the diffusion of silicon from either silicon carbide to tungsten, especially at high temperatures.

Titanium nitride is also both electrically and thermally compatible with tungsten. Titanium nitride is a conductor whose bulk resistivity ($2.2\times10^{-5}\Omega$cm ) and thermal conductivity ($19Wm^{-1}K^{-1}$) are similar those of metals. Moreover, since the thermal expansion coefficient of titanium nitride ($9\times10^{-6}$/° C.) is not very different from that of silicon nitride ($3\times10^{-6}$/° C.) or tungsten ($3\times10^{-6}$/° C.), differential thermal expansion of the components of the ceramic heater of the present invention generates minimal stress.

Figure 1:
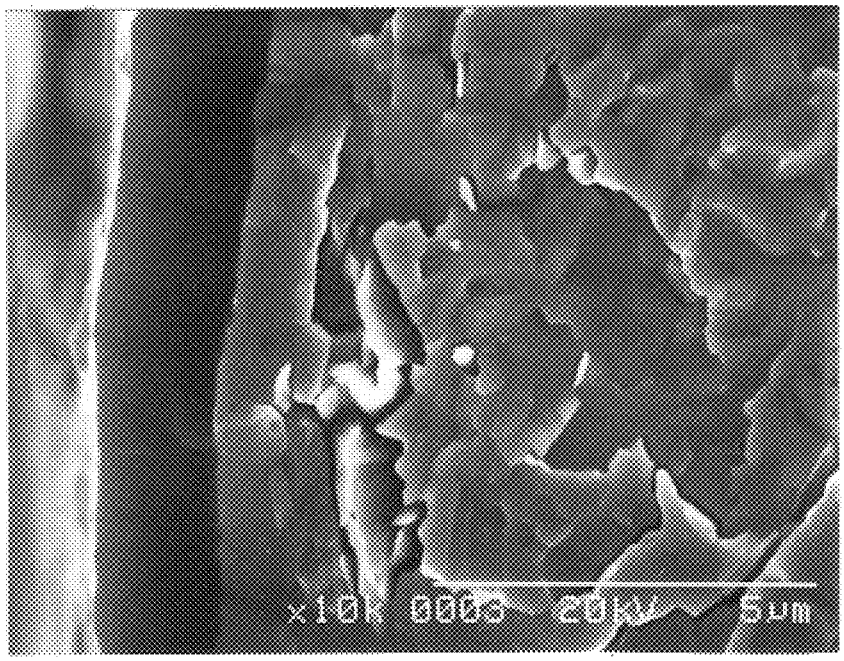
FIG. 1 is an electron microphotograph of a cross section of the titanium nitride coating on a tungsten wire in an embodiment of the ceramic heater of the present invention.

A high-quality, uniform titanium nitride layer may be simply formed on a tungsten heating element by any of several well-known techniques, such as chemical vapor deposition, physical vapor deposition, or plasma-coating. As evidenced by FIG. 1, a microphotograph of a tungsten wire which has been plasma-coated with a 2~10 $\mu$m thick layer of titanium nitride, tungsten and titanium nitride bond easily and well—the interface between the wire and the layer is devoid of cracks.

Figure 2:
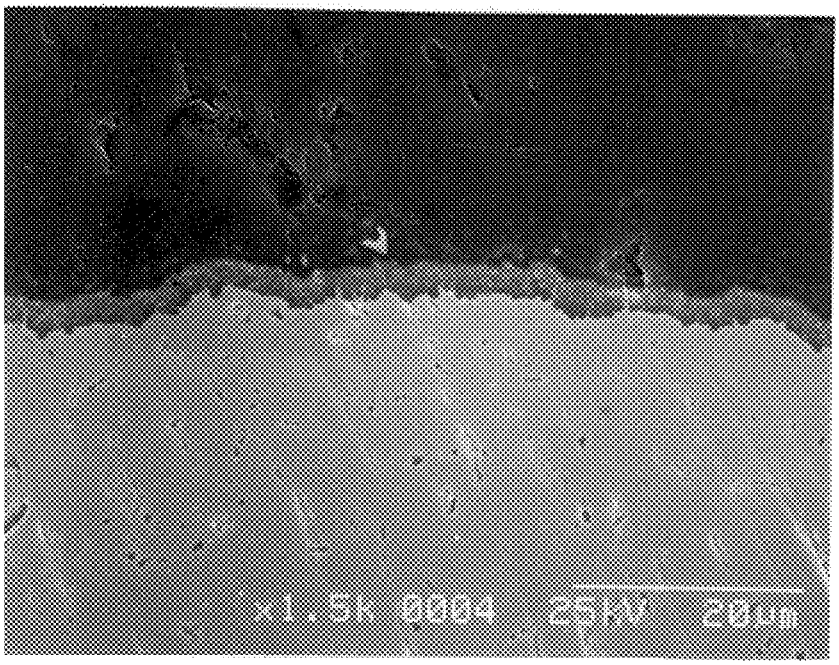
FIG. 2 is an electron microphotograph of the interfaces between the tungsten wire, the titanium nitride diffusion barrier, and the silicon nitride body in an embodiment of the ceramic heater of the present invention.

A ceramic heater complete with projecting positive (+) and negative (−) terminals, suitable for use in a diesel engine glow plug, may then be formed by embedding a tungsten wire coated with titanium nitride in a powder consisting of silicon nitride, silicon carbide, or a mixture of the two, then sintering the structure under pressure in a nitrogen ambient in the temperature range 1600~1800° C. As shown in FIG. 2, a cross-sectional view of the an embodiment of the present invention which has been formed by the process described immediately above, the titanium nitride layer forms a stable diffusion barrier between tungsten and silicon nitride and neither the W/TiN interface nor the $TiN/Si_3N_4$ has any micron-sized cracks.

The contrasting electron micrographs of FIG. 3 provide dramatic evidence of the efficacy of a titanium nitride coating as a silicon diffusion barrier on the tungsten heating element of a silicon nitride ceramic heater. A voltage of 9 V dc was applied for three minutes across the terminals of the tungsten heating elements of two ceramic heaters, one with a titanium nitride coating on the tungsten heating element, the other without. Ohmic heating was sufficient to raise the surface temperature of each heater to 140° C. in the three minutes. The heaters were then allowed to cool by natural convection for three minutes. This six-minute heating-cooling cycle was repeated 100 times.

Figure 3A:
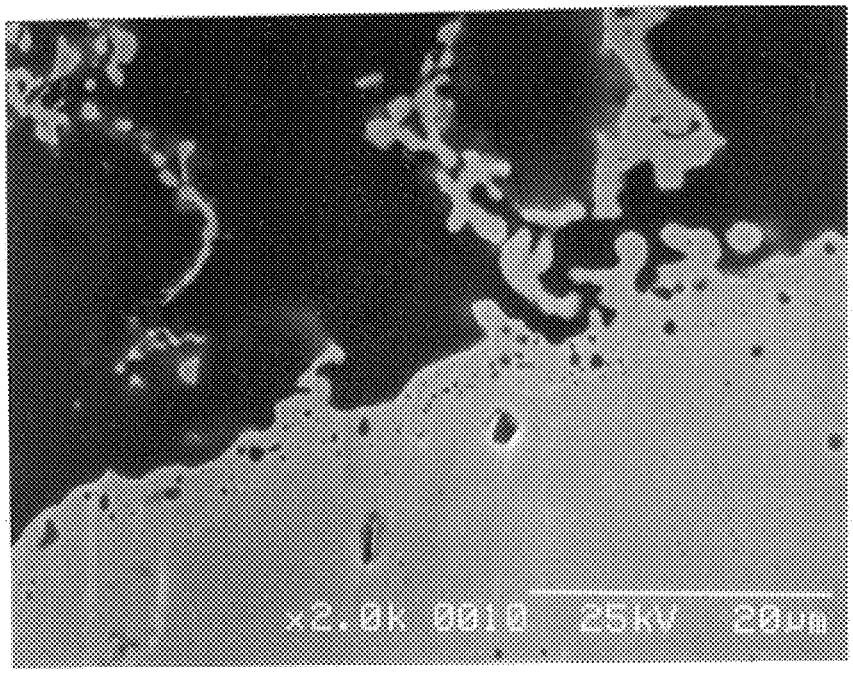
FIG. 3*a* is an electron microphotograph of a cross section of a conventional ceramic heater, showing tungsten silicide and melted tungsten formed after 100 repetitions of a 3-minute heating/3-minute cooling cycle.
Figure 3B:
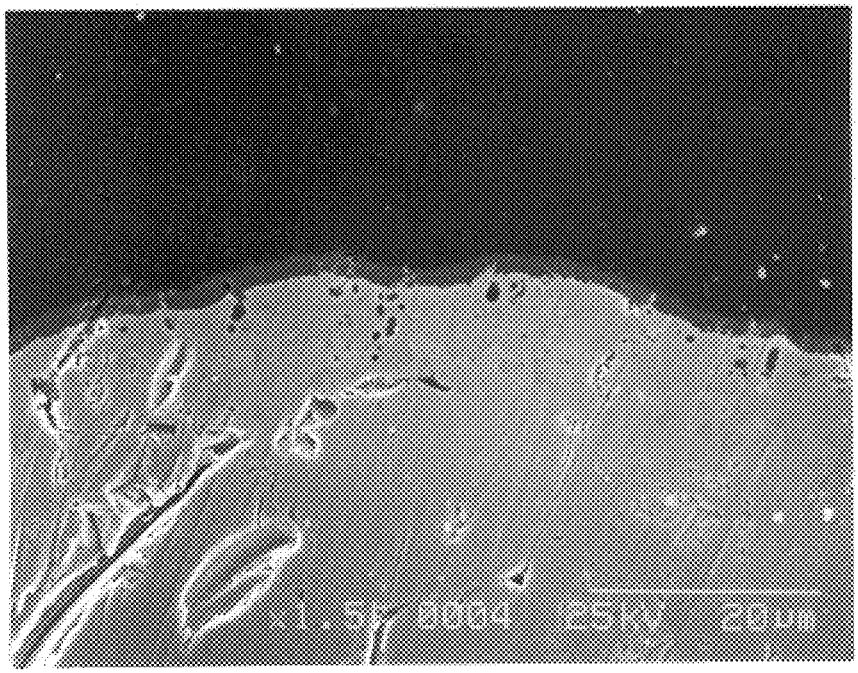
FIG. 3*b* is an electron microphotograph of a cross section of a ceramic heater of the present invention after 100 repetitions of a 3-minute heating/3-minute cooling.

FIG. 3*a* is an electron micrograph of a cross section of a conventional ceramic heater (without the titanium nitride diffusion barrier): tungsten silicide and melted tungsten are both clearly visible. In contrast, neither is apparent in FIG. 3*b*, an electron micrograph of a cross section of a silicon nitride ceramic heater according to an embodiment the present invention.

According to the present invention, a ceramic heater suitable for use in diesel engine glow plugs may be formed by embedding a tungsten resistive heating element coated with a titanium nitride silicon-diffusion barrier within a sintered ceramic body consisting of a silicon-based material. The ceramic heater thus formed may be used at temperatures above 1300° C., which offers the possibility of enhanced cold-start characteristics and decreased emissions. The expected lifetime of the ceramic heater of the present invention is also significantly greater than those of ceramic heaters disclosed in the prior art.

It will be apparent to those skilled in the art that various modifications and variations can be made in the ceramic heater of the present invention without departing from the spirit or scope of the invention. The present invention is thus intended to cover such modifications and variations provided they fall within the scope of the appended claims and their equivalents.

What is claimed is:

1. A ceramic heater comprising:

a heating element;

a coating on the heating element, the coating serving as a barrier to the diffusion of silicon and defining a coated heating element; and a sintered body consisting of a silicon-based ceramic, the sintered body having the coated heating element embedded therein.

2. A ceramic heater according to claim 1, wherein the coating consists of titanium nitride.

3. A ceramic heater according to claim 1, wherein the heating element consists essentially of a refractory metal or an alloy of a refractory metal.

4. A ceramic heater according to claim 2, wherein the heating elements consists essentially of a refractory metal or an alloy of a refractory metal.

5. A ceramic heater according to claim 3, wherein the heating element is a tungsten wire.

6. A ceramic heater according to claim 4, wherein the heating element is a tungsten wire.

7. A ceramic heater according to claim 1, wherein the silicon-based ceramic is selected from the group consisting of silicon nitride, silicon carbide, and a composite of silicon nitride and silicon carbide.

8. A ceramic heater according to claim 2, wherein the silicon-based ceramic is selected from the group consisting of silicon nitride, silicon carbide, and a composite of silicon nitride and silicon carbide.

9. A ceramic heater according to claim 3, wherein the silicon-based ceramic is selected from the group consisting of silicon nitride, silicon carbide, and a composite of silicon nitride and silicon carbide.

10. A ceramic heater according to claim 4, wherein the silicon-based ceramic is selected from the group consisting of silicon nitride, silicon carbide, and a composite of silicon nitride and silicon carbide.

11. A ceramic heater according to claim 5, wherein the silicon-based ceramic is selected from the group consisting of silicon nitride, silicon carbide, and a composite of silicon nitride and silicon carbide.

12. A ceramic heater according to claim 6, wherein the silicon-based ceramic is selected from the group consisting of silicon nitride, silicon carbide, and a composite of silicon nitride and silicon carbide.

* * * * *